US007438240B2

(12) United States Patent
Rabe

(10) Patent No.: US 7,438,240 B2
(45) Date of Patent: Oct. 21, 2008

(54) HAND-HELD SPRAYER FOR HOSE ROLLERS

(75) Inventor: Hermann Rabe, Landsberg (DE)

(73) Assignee: Rational AG, Landsberg/Lech (DE)

( * ) Notice: Subject to any disclaimer, the term of this patent is extended or adjusted under 35 U.S.C. 154(b) by 0 days.

(21) Appl. No.: 10/544,730

(22) PCT Filed: Jan. 7, 2004

(86) PCT No.: PCT/DE2004/000004

§ 371 (c)(1),
(2), (4) Date: Aug. 23, 2006

(87) PCT Pub. No.: WO2004/070253

PCT Pub. Date: Aug. 19, 2004

(65) Prior Publication Data

US 2007/0012804 A1 Jan. 18, 2007

(30) Foreign Application Priority Data

Feb. 6, 2003 (DE) ..... 203 01 844 U

(51) Int. Cl.

| | |
|---|---|
| ***B05B 7/02*** | (2006.01) |
| ***B05B 9/01*** | (2006.01) |
| ***F16K 37/12*** | (2006.01) |
| ***F16K 37/14*** | (2006.01) |
| ***F16K 37/00*** | (2006.01) |
| ***F16K 33/18*** | (2006.01) |
| ***F16K 33/00*** | (2006.01) |
| ***F16K 47/00*** | (2006.01) |
| ***F16K 27/00*** | (2006.01) |
| ***F16K 21/00*** | (2006.01) |

(52) U.S. Cl. ..... 239/525; 239/526; 285/239; 285/242; 285/276; 285/280; 285/305; 285/403

(58) Field of Classification Search ..... 239/525, 239/526, 530, 532, 587.1, 587.5, 587.6, 588; 285/239, 242, 276, 280, 305, 275, 278, 403, 285/404

See application file for complete search history.

(56) References Cited

U.S. PATENT DOCUMENTS 3,527,485 A * 9/1970 Goward et al. ..... 285/305

(Continued)

FOREIGN PATENT DOCUMENTS

DE 804 620 4/1951

(Continued)

OTHER PUBLICATIONS

International Preliminary Examination Report issued in PCT/DE2004/000004 on Dec. 21, 2004.

(Continued)

*Primary Examiner*—Darren W Gorman
(74) *Attorney, Agent, or Firm*—Marshall, Gerstein & Borun LLP

(57) ABSTRACT

A hand-held sprayer includes an at least partially hollow shaft section, a liquid dispensing section and a hollow connecting plug element for connecting a hose extension to the hand-held sprayer. The connecting plug element is arranged within shaft section and can be fastened by a fastening element plugable through at least one opening from the outside into the shaft section and the connecting plug element has a groove running circumferentially around its outer periphery which the fastening element engages when the connecting plug element is fastened to the shaft section.

18 Claims, 3 Drawing Sheets

U.S. PATENT DOCUMENTS

| | | | | |
|---|---|---|---|---|
| 3,973,791 | A * | 8/1976 | Porta et al. | 285/305 |
| 4,171,169 | A * | 10/1979 | Williams | 401/41 |
| 4,431,218 | A * | 2/1984 | Paul, Jr. et al. | 285/305 |
| 4,894,156 | A * | 1/1990 | Murken | 210/448 |
| 5,127,110 | A | 7/1992 | Monch | |
| 5,964,483 | A * | 10/1999 | Long et al. | 285/305 |
| 6,290,263 | B1 | 9/2001 | Murken | |
| 6,446,881 | B1 * | 9/2002 | You | 239/146 |
| 6,983,958 | B2 * | 1/2006 | Rautureau | 285/305 |
| 2003/0001028 | A1 * | 1/2003 | Brattoli et al. | 239/525 |

FOREIGN PATENT DOCUMENTS

| | | | |
|---|---|---|---|
| DE | 33 24 383 | A1 | 1/1984 |
| DE | 38 07 844 | | 9/1989 |
| DE | 92 06 902.9 | | 11/1992 |
| DE | 202 14 901 | | 1/2003 |
| EP | 0 927 580 | B1 | 7/1999 |
| FR | 1 468 174 | | 2/1967 |
| GB | 902 447 | | 8/1962 |

OTHER PUBLICATIONS

International Search Report issued in PCT/DE2004/000004 mailed on Jun. 2, 2004.

English Translation of International Preliminary Report on Patentability issued in PCT/DE2004/000004 dated Feb. 23, 2006.

* cited by examiner

HAND-HELD SPRAYER FOR HOSE ROLLERS

RELATED APPLICATIONS

This is the U.S. national phase of International Application No. PCT/DE2004/000004 filed Jan. 7, 2004, the entire disclosure of which is incorporated herein by reference and claims priority to German application number 203 01 844.3 filed Feb. 6, 2003.

TECHNICAL FIELD

The present invention concerns a hand-held sprayer with an at least partially hollow shaft section, a liquid dispensing section and a hollow connection plug element for connecting a hose extension to the hand-held sprayer, which is arranged within the shaft section and can be fastened by a fastening element plugable through at least one opening from the outside into the shaft section, in which the connecting plug element has a first mounting extension for connecting the hose extension with the connecting plug element and a second mounting extension for connecting the connecting plug element with the shaft section.

BACKGROUND ART

Numerous hand-held sprayers are known from the prior art. These hand-held sprayers are used to divide the liquid jet supplied via a liquid conduit or liquid hose, especially a water jet, and distribute it via a sprayer or nozzle.

Such hand-held sprayers are used especially in the sanitary field, and there especially in showers.

However, hand-held sprayers are often used in large canteen kitchens and are arranged on or in cooking appliances in order to clean the cooking appliance with such hand-held sprayers. For example, cooking spaces within a cooking appliance can be sprayed and cleaned easily by these flexible hand-held sprayers using water and/or cleaning agents.

A generic hand-held sprayer is known from DE 3324383 A1, which discloses a device for fastening a hose to the handle of a hand-held sprayer, with a rigid tube nipple, which is provided with a sealing ring and fastened on the end of the hose with a squeeze clamp, a connection socket fastened to the handle of the hand-held sprayer with a hole passing through it, which from the inside out, forms a first position to the sealing ring, a second position for the squeeze clamp, a laterally opened third position for a fastening bolt and an opening for introduction of the hose, and a fastening bolt, which can be inserted into the third position so that it encloses the hose and to cooperate with the third position to prevent detachment of the squeeze clamp from the second position of the connection socket.

A hand-held sprayer is known from EP 0 927 580 B1 having a liquid feeding section and a liquid dispensing section. An outside threaded connection section is provided on the lower end of the liquid feeding section. This outside thread is used for coupling the connection section to a corresponding swivel nut of a liquid hose extension.

A straight through valve for spraying is known from DE 804 620 arranged in the handle of a spray tube. The handle is provided on the lower end with a nipple that ensures the connection of the feeding line of the spray liquid into the handle. Here again the feed line of the spray liquid is connected to the handle via a screw thread.

A distributor block is known from FR 1468174 in which several tube connections can be inserted. The tube connections are inserted in holes of the distributor block, secured with a seal and fastened to the distributor block with a clip. The tube connection has a groove into which the clip can engage to hold the tube connection.

U.S. Pat. No. 6,290,263 B1 discloses a detachable hose coupling in which two hose ends can be connected to each other by a sleeve. Fastening of the hose ends by the sleeves is accomplished by a U-shaped clamp that can be inserted from the outside into the holes of the sleeve.

Finally, a tube connector containing a rigid sleeve where tube ends can be inserted in is known from GB 902447 A. The sleeve has slit-like recesses that can be inserted into a U-shaped elastic clip in order to join the tube ends to the sleeve.

A drawback in the hand-held sprayers known from the prior art, however, is that an additional space is required in addition to the actual hand-held sprayer in order to provide an additional connector or thread on the lower end of the handle or shaft section, via which the feed hose can be attached. Sealing between the hose extension and handle via such a connector or thread is also often insufficient, especially when the threaded connection is loosened by the variety of rotational movements of the hand-held sprayer and this loosening leads to leakage. Fully free rotational movement of the hand-held sprayer independently of the movement of the feed hose is not guaranteed, i.e., if the hand-held sprayer is rotated 360°, the screw-on feed hose is also rotated accordingly because of the rigid connection.

SUMMARY

It is therefore the task of the present disclosure to further modify the generic hand-held sprayer so that the drawbacks of the prior art are overcome, in particular, a smaller space requirement for connection of the hose to the hand-held sprayer is required and free movement of the hand-held sprayer independently of the movement of the hose is possible.

The task is solved in that the connecting plug element has a groove running circumferentially around its outer periphery in which the fastening element engages when the connecting plug element is fastened to the shaft section and the second mounting extension has essentially the shape of a hollow tube that can be mounted to a third mounting extension in the shaft section formed in one piece with the shaft section.

The first mounting extension is preferably a tube extension having a reduced diameter relative to the connecting plug element and being mountable to the hose extension.

The hand-held sprayer is preferably characterized by at least one seal between the hose extension and the first mounting extension and/or between the second mounting extension and the third mounting extension.

It is also prescribed that each seal is a radially acting O-ring.

With particular preference, the hose extension is securely fastened to the connecting plug element by a securing element, like a hose clamp.

The fastening element also preferably then assumes an essentially U-shape with two arms of the U-shape engaging in the groove of the connecting plug element on opposite sides.

It is then preferably prescribed that the fastening element be a spring steel insert.

With particular preference, the hand-held sprayer is arranged on or in a cooking appliance.

The disclosed hand-held sprayer is therefore based on the surprising finding that because of the special plug system of the hand-held sprayer, in the first place, a situation is achieved in which a limited space is required for connection of a hose to a hand-held sprayer, since the space required for gripping of the hand-held sprayer for this connection, namely the shaft section, is used. In the second place, it is possible with the disclosed hand-held sprayer to achieve torque-independent sealing of the connection of the hand-held sprayer and hose, especially by radially acting O-rings between the corresponding mounting extensions.

Finally, it is emphasized that because of the special plug connection between the hand-held sprayer and the hose, rotation of the hand-held sprayer by 360° around the hose is possible, and this rotation is not interfered with by any fastening elements and does not adversely affect sealing of this connection. If the disclosed hand-held sprayer is rotated, the connected hose does not rotate with it.

BRIEF DESCRIPTION OF THE DRAWINGS

Additional features and advantages of the invention are apparent from the following detailed description of a preferred embodiment of the hand-held sprayer by means of schematic drawings in which.

DETAILED DESCRIPTION

Figure 1:
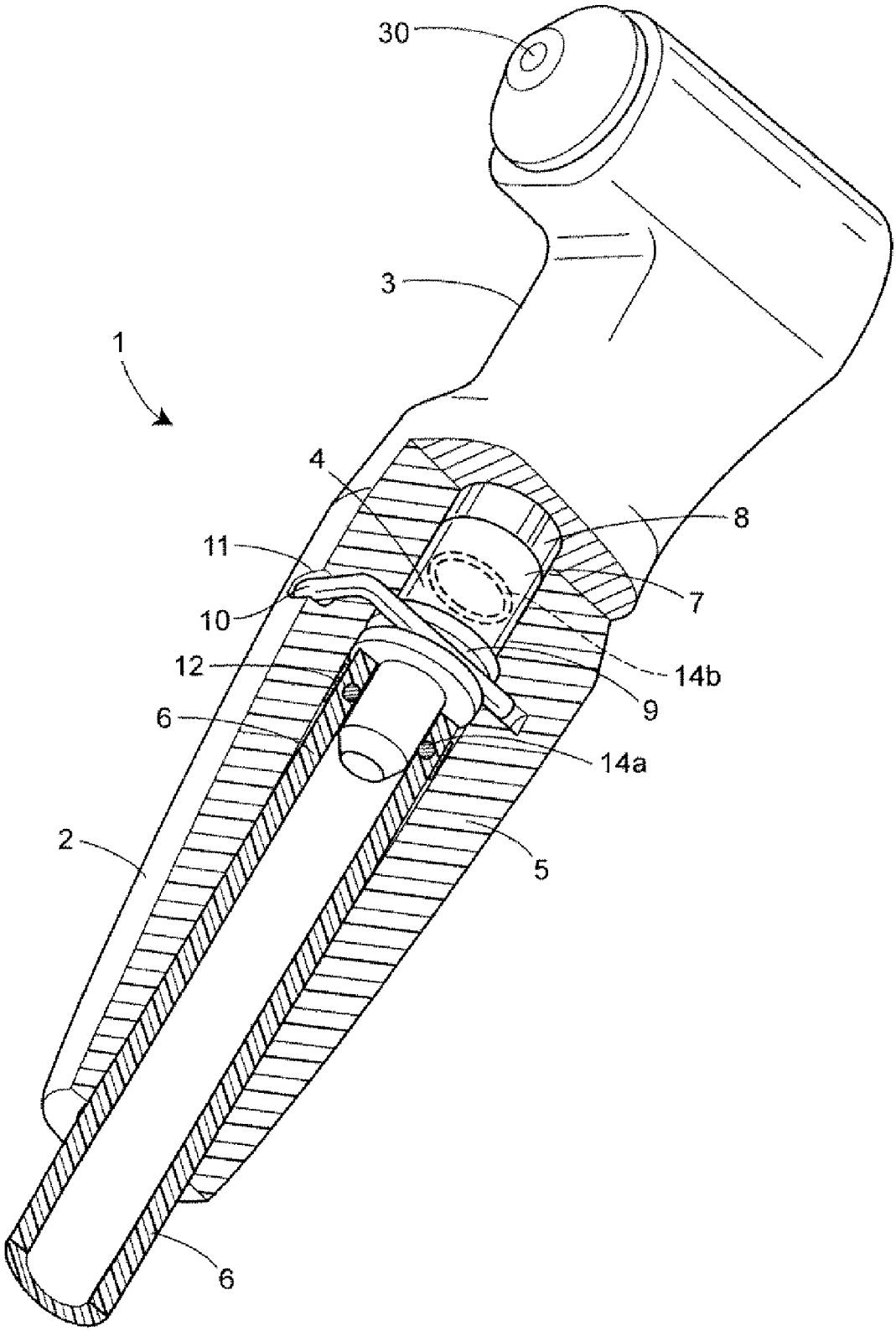
FIG. 1 shows a partial longitudinal section through a preferred embodiment of the hand-held sprayer.

FIG. 1 shows a partial longitudinal section of a hand-held sprayer 1, having a shaft section 2 and a liquid dispensing section 30 that discharges in a spray head 30.

The shaft section 2 is designed at least partially hollow in order to accommodate the plug-in components. A connecting plug element 4 is arranged within shaft section 2. The connecting plug element 4 has a first mounting extension 5 for mounting of a hose extension 6 on connecting plug element 4 and a second mounting extension 7 for connection of the connecting plug element 4 to hand-held sprayer 1. In the preferred embodiment depicted in FIG. 1 of a hand-held sprayer 1, the first mounting extension 5 is a tube extension whose diameter is reduced relative to the diameter of the connecting plug element 4 so that the hose extension 6 can be mounted on this tube extension. The diameter of the tube extension essentially corresponds to the inside diameter of the respective, connectable hose. The hose extension 6 can also be securely fastened to the first mounting extension 5 by one or more hose clamps 12.

The second mounting extension 7 is preferably shaped in the form of a hollow tube that can be mounted on a corresponding third mounting extension 8 of hand-held sprayer 1. The mounting extension 8 of hand-held sprayer 1 can assume the form of a adapter, for example.

Seals 14*a*, 14*b* are preferably provided between the hose extension 6 and the first mounting extension 5, as well as between the second mounting extension 7 and the third mounting extension 8, which prevent liquid supplied via the hose, especially water, from emerging at the corresponding plug connection sites.

The connecting plug element 4 also has a groove 9 running circumferentially on its outer periphery.

If the hose extension 6 is mounted on the connecting plug element 4 and the connecting plug element 4 is connected to hand-held sprayer 1, the connecting plug element 4 can be securely fastened to hand-held sprayer 1 by a fastening element 10. This fastening element 10, which can be introduced through at least one opening 11 of shaft section 2 from the outside into the interior of shaft section 2, engages in the groove 9 of the connecting plug element 4 and secures it so that movement or sliding of the connecting plug element 4 within the shaft section 2 is essentially completely avoided. It is then important that the opening 11 and the groove 9 be arranged so that the fastening element 10 can engage directly in groove 9 when inserted through opening 11.

Figure 2:
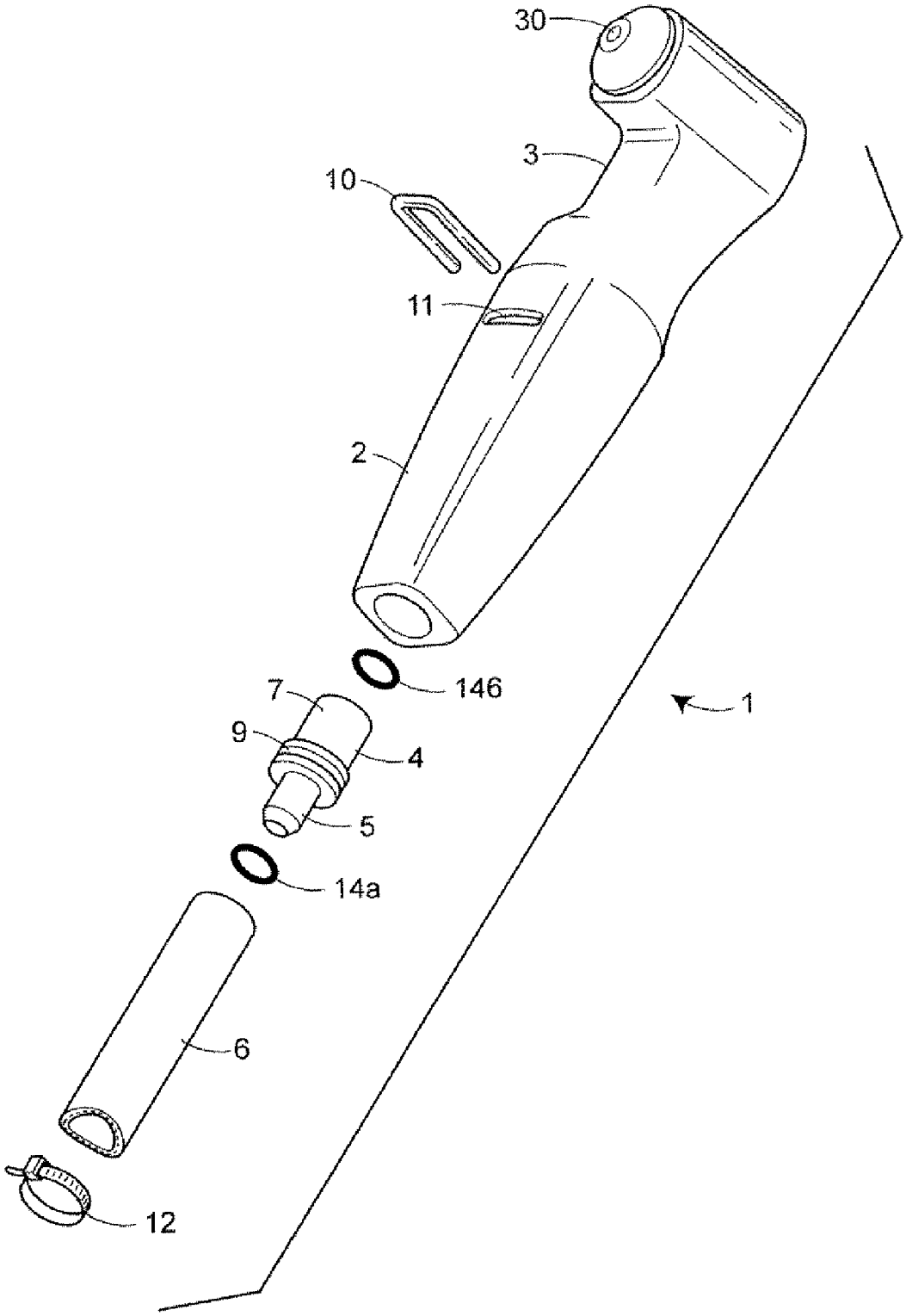
FIG. 2 shows an exploded view of the hand-held sprayer according to FIG. 1.

As shown in particular in FIG. 2, the fastening element 10 is preferably in a U-shape so that both arms of the U-shape can engage through corresponding opening 11 in groove 9 of connecting plug element 4 on opposite sides.

The hose extension 6 can be separated again simply from the hand-held sprayer 1 by removing the fastening element 10 from opening 11 so that the fastening element 10 is disengaged from groove 9. The hose extension can then be withdrawn easily from the hand-held sprayer with the connecting plug element 4.

Figure 3:
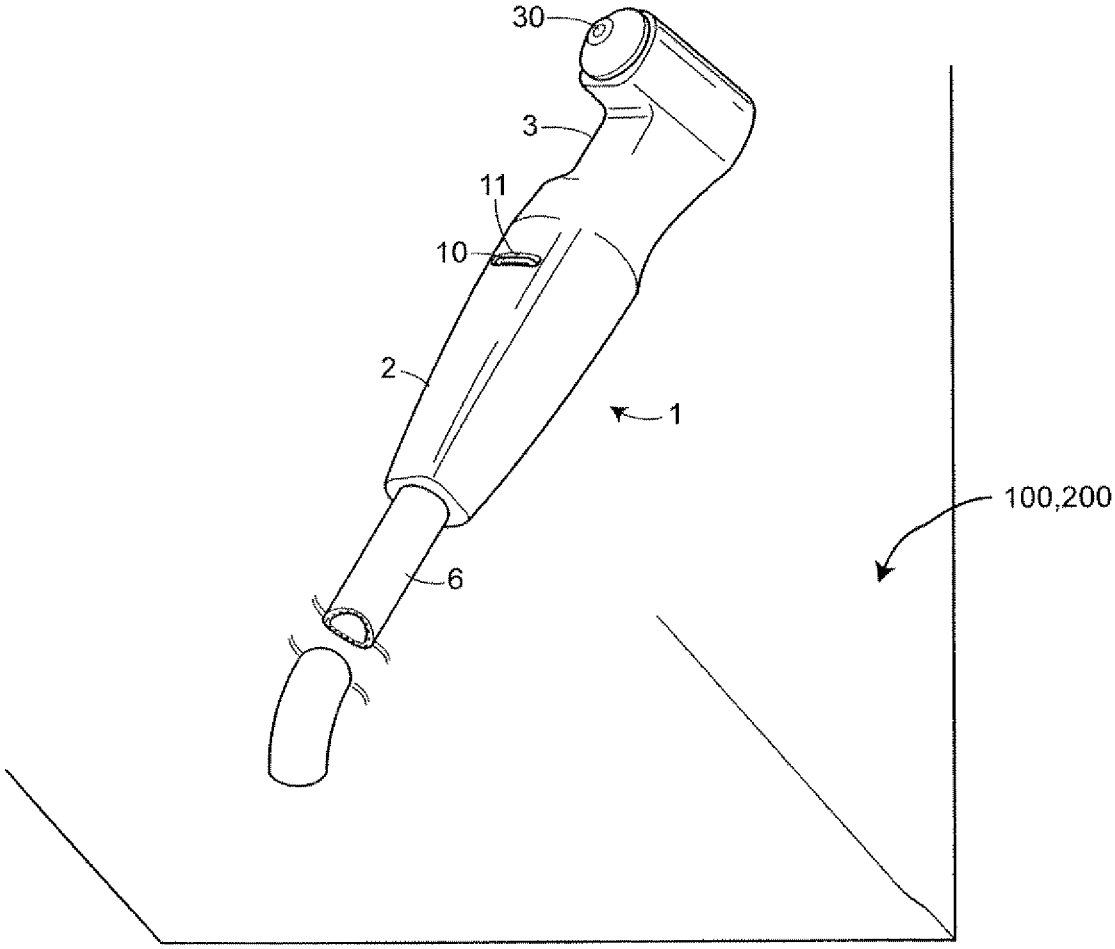
FIG. 3 shows the fully-assembled hand-held sprayer according to FIGS. 1 and 2.

FIG. 3 shows the hand-held sprayer 1 in the fully assembled form. As it is also apparent from FIG. 3, the hand-held sprayer 1 does not require screw threading for attachment of the hose extension to the hand-held sprayer. On the one hand, this reduces the required space, and on the other hand ensures torque-independent sealing of the connection between the hose and the hand-held sprayer as well as free movement of the hand-held sprayer independently of the connected hose.

The hand-held sprayer described herein can be used, for example, in showers 100 or also in cooking appliances 200, as shown in FIG. 3, in order to clean cooking appliances with water and/or cleaning agents.

The features of the invention disclosed in the preceding description, in the claims and in the drawings can be essential both individually and in any combination for the implementation of the invention in its different variants.

LIST OF REFERENCE NUMBERS

1 Hand-held sprayer
2 Shaft section
30 Sprayhead
3 Liquid dispensing section
4 Connecting plug element
5 Mounting extension
6 Hose extension
7 Mounting extension
8 Mounting extension
9 Groove
10 Fastening element
11 Opening

The invention claimed is:

1. Hand-held sprayer arranged on or in a cooking appliance with an at least partially hollow shaft section, a liquid dispensing section, and a hollow connecting plug element for connecting a hose extension to the hand-held sprayer, which is arranged within the shaft section and can be fastened by a fastening element plugable through at least one opening from the outside of the shaft section into the shaft section, in which the connecting plug element has a first mounting extension for connecting the hose extension with the connecting plug element and a second mounting extension for connecting the connecting plug element with the shaft section, the hand-held sprayer comprising:

a groove running circumferentially around an outer periphery of the connecting plug element which the fastening element engages when the connecting plug element is fastened to the shaft section and wherein the second mounting extension has essentially the shape of a hollow tube that can be mounted to a third mounting extension in the shaft section formed in one piece with the shaft section.

2. Hand-held sprayer according to claim 1, wherein the first mounting extension is a tube extension that has a reduced diameter relative to the connecting plug element and is mountable to the hose extension.

3. Hand-held sprayer according to claim 2, further including at least one seal disposed between the hose extension and the first mounting extension or between the second mounting extension and the third mounting extension.

4. Hand-held sprayer according to claim 3, wherein the seal is a radially-acting O-ring.

5. Hand-held sprayer according to claim 1, wherein the hose extension is securely fastened to the connecting plug element by a securing element.

6. Hand-held sprayer according to claim 1, wherein the fastening element essentially comprises a U-shape with two arms of the U-shape engaging in the groove of the connecting plug element on opposite sides.

7. Hand-held sprayer according to claim 1, wherein the fastening element is a spring steel insert.

8. Hand-held sprayer according to claim 5, wherein the securing element is a hose clamp.

9. Hand-held sprayer according to claim 2, further including at least one first seal disposed between the hose extension and the first mounting extension and at least one second seal disposed between the second mounting extension and the third mounting extension.

10. A hand-held sprayer arranged on or in a cooking appliance for use with a hose extension, comprising:

an at least partially hollow shaft section;

a liquid dispensing section;

a fastening element; and a hollow connecting plug element for connecting the hose extension to the shaft section, wherein the hollow connecting plug element is arranged within the shaft section and can be fastened by the fastening element through at least one opening from the outside of the shaft section into the shaft section, wherein the connecting plug element has a first mounting extension for connecting the hose extension with the connecting plug element, a second mounting extension for connecting the connecting plug element with the shaft section and a groove running circumferentially around an outer periphery of the connecting plug element which the fastening element engages when the connecting plug element is fastened to the shaft section and wherein the second mounting extension has essentially the shape of a hollow tube that can be mounted to a third mounting extension in the shaft section formed in one piece with the shaft section.

11. The hand-held sprayer according to claim 10, wherein the first mounting extension is a tube extension that has a reduced diameter relative to the connecting plug element and is mountable to the hose extension.

12. The hand-held sprayer according to claim 11, further including at least one seal disposed between the hose extension and the first mounting extension or between the second mounting extension and the third mounting extension.

13. The hand-held sprayer according to claim 12, wherein the seal is a radially-acting O-ring.

14. The hand-held sprayer according to claim 11, further including at least one first seal disposed between the hose extension and the first mounting extension and at least one second seal disposed between the second mounting extension and the third mounting extension.

15. The hand-held sprayer according to claim 10, further including a securing element that securely fastens the hose extension to the connecting plug element.

16. The hand-held sprayer according to claim 15, wherein the securing element is a hose clamp.

17. The hand-held sprayer according to claim 10, wherein the fastening element comprises a U-shaped element with two arms of the U-shaped element engaging in opposite sides of the groove of the connecting plug element.

18. The hand-held sprayer according to claim 10, wherein the fastening element is a spring steel insert.

* * * * *